US005533864A

United States Patent [19]

Nomoto et al.

[11] Patent Number: 5,533,864

[45] Date of Patent: Jul. 9, 1996

[54] TURBINE COOLING BLADE HAVING INNER HOLLOW STRUCTURE WITH IMPROVED COOLING

[75] Inventors: Hideo Nomoto, Chigasaki; Takanari Okamura; Shoko Ito, both of Yokohama, all of Japan

[73] Assignee: Kabushiki Kaisha Toshiba, Kawasaki, Japan

[21] Appl. No.: 343,956

[22] Filed: Nov. 17, 1994

[30] Foreign Application Priority Data

Nov. 22, 1993 [JP] Japan ..... 5-292116

[51] Int. Cl.[6] ..... F01D 5/18

[52] U.S. Cl. ..... 416/96 A; 416/97 R; 415/115

[58] Field of Search ..... 415/115; 416/96 A, 416/96 R, 97 R

[56] References Cited

U.S. PATENT DOCUMENTS

| | | | |
|---|---|---|---|
| 3,806,276 | 4/1974 | Aspenwall | 416/97 |
| 4,118,146 | 10/1978 | Dieberger | 415/115 |
| 4,183,716 | 1/1980 | Takahara et al. | 415/115 |
| 5,027,604 | 7/1991 | Krueger | 416/96 A |
| 5,259,730 | 11/1993 | Damlis et al. | 416/97 R X |
| 5,363,654 | 11/1994 | Lee | 415/115 X |
| 5,391,052 | 2/1995 | Correia et al. | 415/115 X |

FOREIGN PATENT DOCUMENTS 63-306204 12/1988 Japan .

4-265403 9/1992 Japan .

*Primary Examiner*—Edward K. Look
*Assistant Examiner*—Michael S. Lee
*Attorney, Agent, or Firm*—Oblon, Spivak, McClelland, Maier & Neustadt

[57] ABSTRACT

A turbine cooling blade has a blade body defining an inner hollow portion, an insert core fitted into the inner hollow portion of the blade body with a space therebetween, and a plurality of projections formed on the insert core so as to project towards an inner surface of the blade body. The projections are formed with impingement holes through which cooling air flows from an inside of the insert core towards the space between the insert core and the blade body. The blade body is provided with a plurality of partitioning members partitioning the space into a plurality of sectioned chambers between the insert core and an inner surface of the blade body. The insert core member is formed with a number of impingement holes at portions other than the partitioning members, and the partitioning members extend in a span direction of the blade body. Cooling air flows from an inside of the insert core towards the chambers through the impingement holes, and the blade body is provided with a plurality of film cooling holes each penetrating the blade body from the chambers to an outer atmosphere side of the blade body and extending in a radial direction the blade body.

9 Claims, 14 Drawing Sheets

TURBINE COOLING BLADE HAVING INNER HOLLOW STRUCTURE WITH IMPROVED COOLING

BACKGROUND OF THE INVENTION

The present invention relates to a turbine cooling blade of a gas turbine used for power generation and industry, and more particularly, to cooled turbine blade having an inner hollow structure in which an insert core having an improved structure is accommodated.

A gas turbine used for a power plant is generally arranged as shown in FIG. 11, in which compressed air which is compressed by driving a compressor 2 coaxially provided with a gas turbine 1 is supplied to a combustor 3, fuel is burnt in the liner portion 3*a* of the combustor 3, and a high temperature combustion gas resulting from the combustion is guided to moving blades 6 through a transition piece 4 and stationary blades 5 of the gas turbine 1, so that the gas turbine 1 delivers work by the rotation of the moving blades 6.

Incidentally, in order to improve the heat efficiency of a gas turbine, it is preferable to increase the turbine inlet temperature and, actually, the turbine inlet temperature is increased for this purpose. As the turbine inlet temperature is increased, it becomes necessary to use a material resistant to high temperature for the combustor 3, the stationary blades 5 and the moving blades 6 of the gas turbine 1 and a heat resistant super-alloy material has been hence been used in gas turbine parts.

Although a heat resistant super-alloy material used in high temperature parts of the turbine has a critical temperature of 800°–900° C. at present, a turbine inlet temperature reaches about 1300° C. which greatly exceeds the critical temperature. Thus, it is essential to employ a cooled blade to which a cooling structure is applied to maintain the reliability of the gas turbine by cooling the blade to the critical temperature.

Air is used as an operating fluid in many cases to cool a blade to its critical temperature, and the air is supplied by being partially extracted from a mid-portion of the compressor 2 or from the path from the outlet of the compressor 2 to the combustor 3. When a larger amount of cooling air is used, the air can further reduce the temperature of the blade. However, the cooling air does not generate an output power until it is collected at a gas passage, and if the cooling air is collected at the gas passage, it reduces the gas temperature. Consequently, the efficiency of a gas turbine is lowered, so that any efficiency improvement due to increased inlet temperature is canceled. Thus, it is an important problem to provide effective cooling using an air flow amount which is as small as possible.

Presently, an air cooled blade as shown in FIG. 12 and FIG. 13 is used to a gas turbine having a turbine inlet temperature of about 1300° C. FIG. 13 is a cross sectional view taken along the line XIII—XIII of FIG. 12. In order to make the following description more understandable, the x-direction, y-direction and z-direction are defined herein as shown in FIGS. 12, 13 and 15.

As shown in FIG. 12 and FIG. 13, an insert core 7 having an inner hollow structure is accommodated in the stationary blade (hereinafter, referred to as a cooling blade main body) 5. The insert core 7 is generally supported in the blade main body 5 at both end portions in a span direction of the blade body 5, and a rib member 5*a* is normally disposed inside the blade body 5 to support the insert core 7 and further to carry out heat radiation through the rib member 5*a*. Cooling air 8 is first supplied into the insert core 7, is converted to impingement cooling air 9*a* by passing through the many impingement holes 9 defined in the insert core 7, and then impinges on the inner surface of the cooling blade main body 5. It is conventionally known that a fluid impinging on a fixed wall at high speed as described above generally has a very high heat transfer coefficient and thus a high cooling efficiency, which is called impingement cooling.

This cooling method is an important cooling technology for managing the cooling effect of the inner surface of the cooling blade main body 5, i.e., an inner surface heat transfer coefficient. Air having once cooled the inner surface of the cooling blade main body 5 then flows out from film holes 10 to the outside in such a fashion that it covers the outer surface of the cooling blade main body 5 in the form of a film. The cooling air film protects the outer surface of the cooling blade main body 5 from high temperature.

Although the cooling air 8 flows to the outside by successively passing through the insert core 7, the impingement holes 9, and the film holes 10 in this order, the cooling air 8 flows from a front edge 12 to a rear edge 13 in a space 11 between the insert core 7 and the cooling blade main body 5. Pin fins 14 are provided in the cooling blade body 5 to increase the heat transfer coefficient and to obtain a fin effect due to the increase of heat transfer area.

FIG. 14 is a view observed from the C direction of FIG. 12 to show a cooling method of a shroud segment 15, in which not only the cooling blade main body 5 but also the shroud segment 15 are subjected to impinge cooling in a gas turbine. That is, many impingement holes 9 are defined to a diaphragm 16, and the shroud segment 15 is cooled by the impingement cooling. Although FIG. 14 shows the impingement cooling applied to a blade root portion, the same cooling technology is also applied to the shroud segment at the extreme end portion of the blade.

Problems of the prior art impingement cooling will be described below. Although impingement cooling is applied to both the cooling blade main body 5 and the shroud segment 15 as described above, since they have the same structure, only the cooling of the cooling blade main body 5 will be described below.

In the gas turbine blade, since the entire surface of the cooling blade main body 5 must be uniformly cooled, the many impingement cooling holes 9 must be defined. As shown in FIG. 15 and FIG. 16, the cooling air 8 flows out from the impingement cooling holes 9 defined in the insert core 7, is converted to impingement cooling air 9*a*, and impinges on the inner surface of the cooling blade main body 5. It is known that the impingement cooling maximizes the heat transfer coefficient when cooling air impinges perpendicularly on a solid surface to thereby increase the cooling effect. Thus, the states shown in FIG. 15 and FIG. 16 are ideal.

However, in actuality, the cooling air flows as shown in FIG. 17 and FIG. 18. That is, after impinging on the inner surface of the cooling blade main body 5, the impingement cooling air 9*a* flows from the front edge 12 to the rear edge 13 in the x-direction in the space 11 between the insert core 12 and the cooling blade main body 5 and is converted to cooling air 11*a* for the space 11. However, this flow of the cooling air 11*a* interferes with the flow of the cooling air 9*a*. Therefore, the impingement cooling air 9*a* does not always impinge perpendicularly on the inner surface of the cooling blade main body 5 and it is impossible to realize the ideal state.

More specifically, when the inner wall of the blade is to be cooled by an impingement jet flow from the insert core 7, as a cross flow flowing between the insert core 7 and the inner wall of the blade is increased with respect to the jet flow, the impingement cooling effect is reduced. Then, in the prior art inside cooling structure, a problem arises in that as the cooling air approaches from the front edge 12 toward the impingement hole row on the downstream side in the rear edge 13, the cross flow of the cooling air which has performed the impingement cooling on the upstream side is increased and it is difficult to obtain a desirable impingement cooling effect.

Further, as the inlet temperature of a gas turbine is increased, an amount of cooling air needed is increases. In particular, when the inlet temperature is 1300° C. or higher, the amount of cooling air is remarkably increased. Moreover, since convection cooling in the inside of the blade is not sufficient, a film cooling method of blowing off cooling air from the film holes 10 defined in the blade surface to the outside of the blade described above must be used together with the convection cooling.

The film cooling method is not only effective for cooling but also prevents a further increase of thermal stress in the metal portion of the blade due to high temperature. As described above, although the application of the film cooling method is effective to cool the cooling blade of a gas turbine, when temperature is further increased, a full coverage film cooling (FCFC) method must be employed to blow off cooling air to the entire surface of the blade.

Since the effect of the film cooling greatly varies depending upon blow-off conditions to a main flow (such as density ratio, mass to quantity of flow ratio, quantity of motion ratio) (that is, there are optimum conditions), there is a possibility that a maximum cooling effect cannot be obtained even by employing the FCFC method. In the case of a turbine stationary blade, there is a large difference in a static pressure on a blade surface onto which cooling air is blown off, depending upon the locations of the blade surface, due to the characteristics of the stationary blade.

Regardless of this fact, the pressure in the space 11 formed between the insert core 7 and the hollow inner wall is kept at a given value in the prior art inside cooling structure. As a result, there is a problem that the pressure of the cooling air, just before it is blown off, cannot be optimized depending upon the location to which the cooling air is blown off and optimum blow-off conditions (such as density ratio, mass to quantity of flow ratio, quantity of motion ratio) cannot be obtained.

SUMMARY OF THE INVENTION

An object of the present invention is to substantially eliminate defects or drawbacks encountered in the prior art and to provide a turbine cooling blade capable of attenuating the interference with cooling air after impingement by which the cooling effect of impingement cooling is reduced, and complying with the increased inlet temperature of a gas turbine to thereby improve the operational efficiency of the gas turbine.

Another object of the present invention is to provide a turbine cooling blade capable of improving the film cooling performance of a cooling blade main body and performing excellent cooling even at an increased gas temperature.

These and other objects can be achieved according to an aspect of the present invention by providing a turbine cooling blade comprising a blade body having a structure defining an inner hollow portion; an insert core member fitted into the inner hollow portion of the blade body with a space therebetween; and a plurality of projections formed in said insert core member so as to project towards an inner surface of the blade body, said projections being formed with impingement holes through which cooling air flows from an inside of the insert core member towards the space between the insert core member and the blade body.

In preferred embodiments of this aspect, each of the projections has an cylindrical outer appearance provided with an impingement hole. The projections are each formed so as to provide a channel protruded from the insert core towards the inner surface of the blade body and may be arranged in a row in a direction substantially parallel to a flow direction of the cooling air. The impingement hole has a circular shape.

The space between the insert core member and the inner surface of the blade body is formed so as to be widened towards a downstream side of the flow of the cooling air.

In another aspect of the present invention, there is provided a turbine cooling blade comprising a blade body having a structure defining an inner hollow portion; an insert core member fitted into the inner hollow portion of the blade body with a space therebetween; and a plurality of partitioning members partitioning the space into a plurality of sectioned chambers between the insert core member and an inner surface of the blade body, wherein the insert core member is formed with a number of impingement holes at portions except for the partitioning members, the partitioning members extending in a span direction of the blade body, a cooling air flows from an inside of the insert core towards the sectioned chambers through the impingement holes, and the blade body is provided with a plurality of film cooling holes each penetrating a wall of the blade body from the sectioned chambers to an outer atmosphere side of the blade body and extending in a radial direction of the blade body.

In preferred embodiments of this aspect, the partitioning members as projections are formed so as to project from the insert core member towards the inner surface of the blade body and abut at projected end portions thereof against the inner surface of the blade body. The blade body is formed with a plurality of recessed portions to which the projected end portions of the projections are fitted respectively.

The partitioning members may be formed to the blade body as projections so as to project from the inner surface of the blade body towards an outer surface of the insert core member body and abut at projected end portions thereof against the outer surface of the insert core member.

The insert core member is formed with a plurality of recessed portions to which the projected end portions of the projections are fitted respectively.

The partitioning members are formed integrally with the insert core member or blade body.

According to the present invention, since the projections are formed in the insert core so as to project towards the cooling blade body, with the impingement cooling holes defined in the projections, the space between the insert core and the blade body can be increased. As a result, the flow velocity of the cooling air having performed impingement cooling is reduced so that the interference of the cooling air with cooling air after impingement, due to which the cooling effect of the impingement cooling is lowered, can be attenuated.

Furthermore, since the projections are formed in a row in a direction parallel to the cooling air flow, the turbine cooling blade has a large effective space area.

It is preferred that the space between the insert core and the cooling blade main body increases toward the downstream side of the cooing air to improve the cooling efficiency.

According to the other aspect of the present invention, since the space formed between the cooling blade body and the insert core is divided into a plurality of sectioned chambers or cells, and a plurality of the film cooling holes are defined in each of the chambers in the radial direction of the cooling blade body for blowing off the cooling air from each of the chambers outside the blade body, the pressure of the cooling air in each chamber can be kept to an optimum pressure in accordance with the static pressure of a blade surface so that a maximum film cooling effect for the outer surface of the blade body can be obtained.

Further, the effect of a cross flow against a jet flow for performing the impingement cooling of a blade inner wall from the insert core can be suppressed so that the impingement cooling effect is also increased.

Furthermore, the projected portions of the insert core are engaged with the recessed portions of the cooling blade body, or the projected portions of the cooling blade main body may be engaged with the recessed portions of the insert core, so that cooling air can be sealed effectively in the chambers.

The nature and further features of the present invention will be made more clear from the following descriptions made with reference to the accompanying drawings.

DESCRIPTION OF THE PREFERRED EMBODIMENTS

Embodiments of the present invention will be described below with reference to the accompanying drawings.

Figure 1:
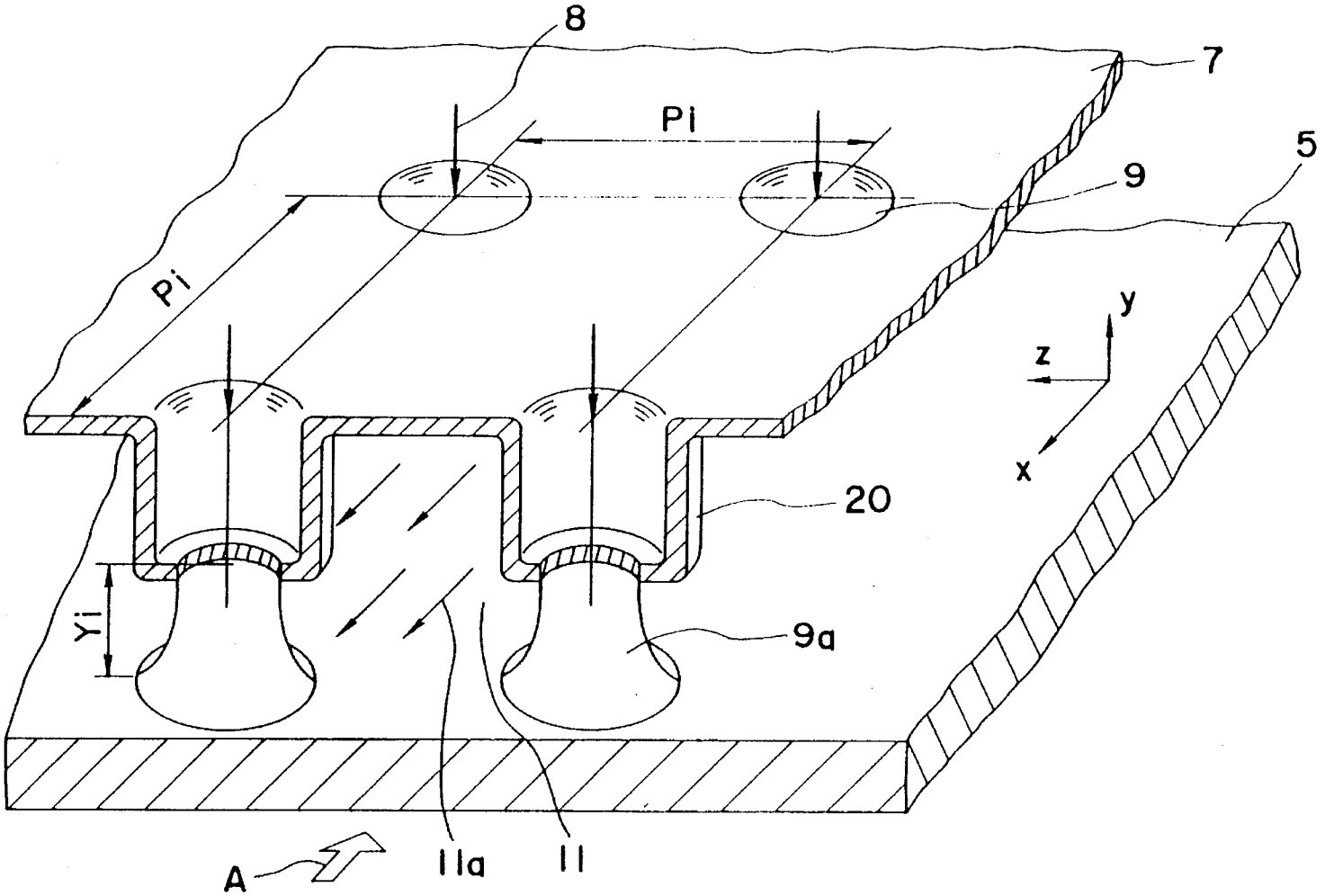
FIG. 1 is an enlarged perspective view showing the main portion of a first embodiment of a turbine cooling blade according to the present invention.
Figure 2:
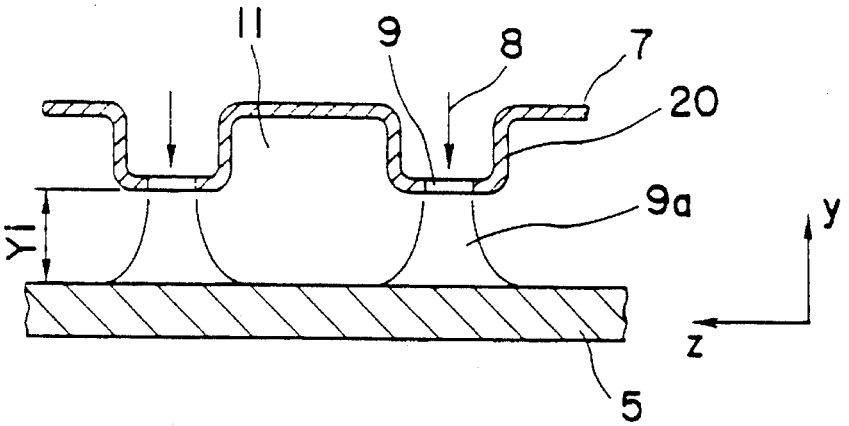
FIG. 2 is a view observed from the A direction of FIG. 1.

FIG. 1 is an enlarged perspective view showing the main portion of a first embodiment of a turbine cooling blade according to the present invention and FIG. 2 is a view observed from the A direction of FIG. 1, in which parts or members having arrangements similar or corresponding to the conventional arrangements shown in FIGS. 11 to 18 are described by using the same numerals. Since the overall arrangement of a cooling blade main body is the same as the arrangement shown in FIG. 12 and FIG. 13, the description thereof is omitted.

As shown in FIG. 1 and FIG. 2, an insert core 7 formed in a hollow structure is accommodated in a cooling blade main body 5, cooling air 8 is first supplied into the insert core 7 and passes through many impingement holes 9 defined to the insert core 7, and the thus obtained impingement cooling air 9*a* impinges on the inner surface of the cooling blade main body 5.

In this embodiment, many cylindrical projections 20 are formed on the insert core 7 so as to project to the cooling blade main body 5 side and a disk (circular) shaped impingement hole 9 is defined in the extreme end of each of the projections 20. With this arrangement, space 11 has an increased area and a large flow path for the cooling air 11*a* is formed in the space.

When the insert core 7 is a diaphragm and the cooling blade main body 5 is a shroud segment, this arrangement can also be applied to the shroud segment in entirely the same way.

More specifically, in the arrangement in which the diaphragm is provided with the shroud segment, the impingement cooling holes 9 are defined in the diaphragm, and the shroud segment is cooled by the cooling air 9*a* supplied from the impingement cooling holes 9, the projections 20 projecting to the shroud segment side may be formed on the diaphragm and the impingement hole 9 may be defined in each of the projections 20.

The operation of this embodiment will be described hereunder.

The embodiment intends to reduce the interference of the impingement cooling air 9*a* with the space cooling air 11*a*. A reason why an ideal state in which the impingement cooling air 9*a* perpendicularly impinges on the inner surface of the cooling blade main body 5 cannot be realized is apparently the fact that the impingement cooling air 9*a* is bent in the x-direction by the flow component in the x-direction of the space cooling air 11*a*.

The bending amount of the impingement cooling air 9*a* in the x-direction can be reduced by reducing the quantity of flow of mass of the space cooling air 11*a* or reducing the flow velocity thereof. Since the space cooling air 11*a* results from the impingement cooling air 9*a* having impinged on the inner surface of the cooling blade main body 5, however, the quantity of flow of the impingement cooling air 9*a* itself must be reduced to reduce the quantity of flow of mass. This method, however, is not advantageous because the efficiency of impingement cooling is thereby reduced.

Thus, when the area of the space 11 is increased by forming the projections 20 as in this embodiment, a path dedicated for the cooling air 11*a* is provided so that the flow velocity can be reduced without reducing the quantity of the air flow.

Figure 3A:
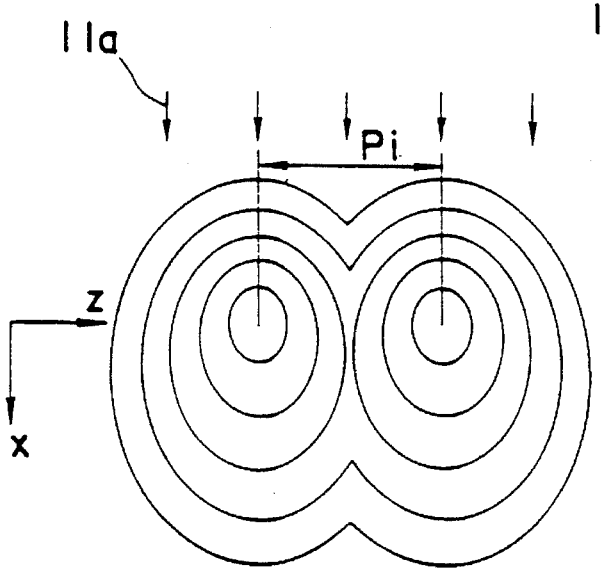
FIGS. 3A and 3B are views qualitatively comparing the local heat transfer coefficient of the first embodiment and the local heat transfer coefficient of the prior art.
Figure 3B:
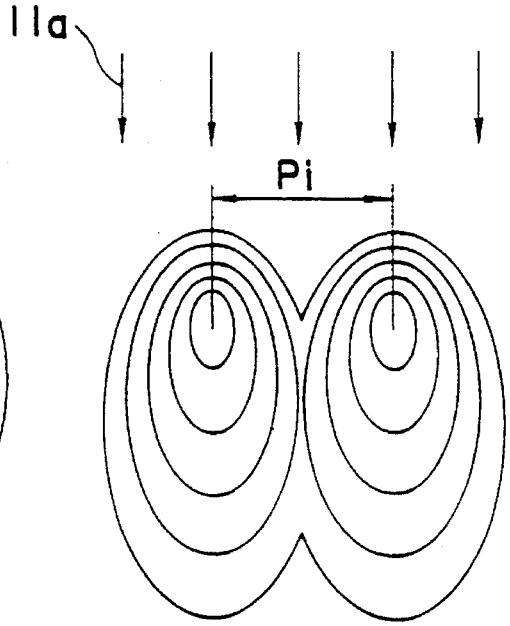
FIG 3B PRIOR ART

FIGS. 3A and 3B are views qualitatively comparing the local heat transfer coefficient according to this embodiment with that of the prior art, and in these figures, the uniform heat transfer coefficient curve shows a higher heat transfer coefficient in the inside thereof.

In the prior art shown in FIG. 3B, since the space cooling air 11*a* has a high flow velocity, the jet flow for the impingement cooling is bent and obliquely impinges on the inner surface of the cooling blade main body 5 and, as a result, the heat transfer coefficient is reduced and the uniform heat transfer coefficient curves of the prior art are formed in a flat ellipse shape.

On the other hand, as shown in FIG. 3A, with this embodiment in which the space cooling air 11*a* has a reduced flow velocity, since the impingement cooling air 9*a* impinges perpendicularly on the inner surface of the cooling blade main body 5 in the vicinity thereof, the heat transfer coefficient is increased and the uniform heat transfer coefficient curves of the embodiment are formed in a less flat ellipse shape. Therefore, this embodiment has a higher average heat transfer coefficient and can obtain a more effective cooling effect.

D. M. Kercher and W. Tabakoff systematically experimented for the reduction of a heat transfer coefficient caused by the interference of the impingement cooling air 9*a* with the space cooing air 11*a* and obtained an experimental formula subjected to a dimension-free processing as shown in "Heat Transfer by a Square Array of Round Air Jets Impinging Perpendicular to a Flat Surface Including the Effect of Spent Air", Transaction of AMSE, Journal of Engineering for Power, January 1970, Page 73–82. According to the experimental formula, when a heat transfer coefficient is expressed in the form of a Nusselt's number NuD,X as a dimensionless value by taking the space cooling air 11*a* into consideration, the heat transfer coefficient is expressed as follows.

$$NuD,X=hD/k \quad (1)$$

where, NuD,X is a Nusselt's number when space cooling air is taken into consideration, h is a heat transfer coefficient (Kcal/m$^2$hr°C.), k is a heat conductivity (Kcal/mhr°C.), and D is an impingement hole diameter (m).

The result of the experiment is explained by the following formula $$NuD,X=\phi 1\phi 2\ ReD^{m}Pr^{1/3}(Yi/D)^{0.091}$$

where, ReD is a Reynold's number and ReD=ρVD/μ•ρ is a density (Kg/m$^3$), is a velocity (m/s), μ is a coefficient of viscosity (Kg/ms), Pr is a Prandtl number, and Yi is a distance between the impingement hole and the cooling blade main body 5. The exponent m of the Reynold's number is a quantity determined experimentally in the form of m=f(Pi/D,ReD) and a function of Pi/D and ReD. Pi is a pitch (m) of the impingement hole, and, ϕ1 is also a quantity determined experimentally in the form of ϕ1=f (Pi/D, ReD) and a function of Pi/D and ReD.

Further, the final ϕ2 is a correction parameter for the reduction of the heat transfer coefficient due to the existence of the space cooling air and arranged in the following form.

$$\phi 2=NuD,X/NuD=f\ \{(Wx,i/Wi)(Yi/D),\ ReD)$$

Thus, ϕ2 is a function of the dimensionless value (Wx,i/Wi) (Yi/D) and ReD. In the formula, Wx,i is a mass (Kg/m$^2$s) per unit area of the space cooling air, Wi is a quantity of flow of mass per unit area of the impingement cooling air (Kg/m$^2$s), and NuD is a Nusselt's number when there is no space cooling air.

According to the result of the experiment in the above literature, as the dimensionless value (Wx,i/Wi) (Yi/D) is further increased, the heat transfer coefficient is further reduced. That is, when the quantity of flow of mass per unit area Wx,i of the space cooing air 11 is increased, the heat transfer coefficient is reduced, which is a reasonable result. Further, even if the distance Yi between the impingement hole 9 and the cooling blade main body 5 is increased, the same result is quantitatively obtained, which is a phenomenon capable of being understood from the fact that when the distance Yi is large, a quantity of the impingement cooling air 9*a* to be bent is increased. Therefore, the flow velocity in the space 11 must be reduced while keeping the distance Yi as long as that of the prior art.

In FIG. 1, when it is supposed that the space 11 is increased while keeping the distance Yi between the i-th impingement hole from the front edge and the cooling blade main body 5 and the quantity of flow per unit area of the impingement cooling air 9*a* as large as those of the prior art by forming the projection 20 in the impingement hole 9, the quantity of flow of mass per unit area Wx,i of the space cooling air 11*a* is reduced by the increase of the area of the space 11, so that the reduction of the heat transfer coefficient can be prevented.

Figure 4:
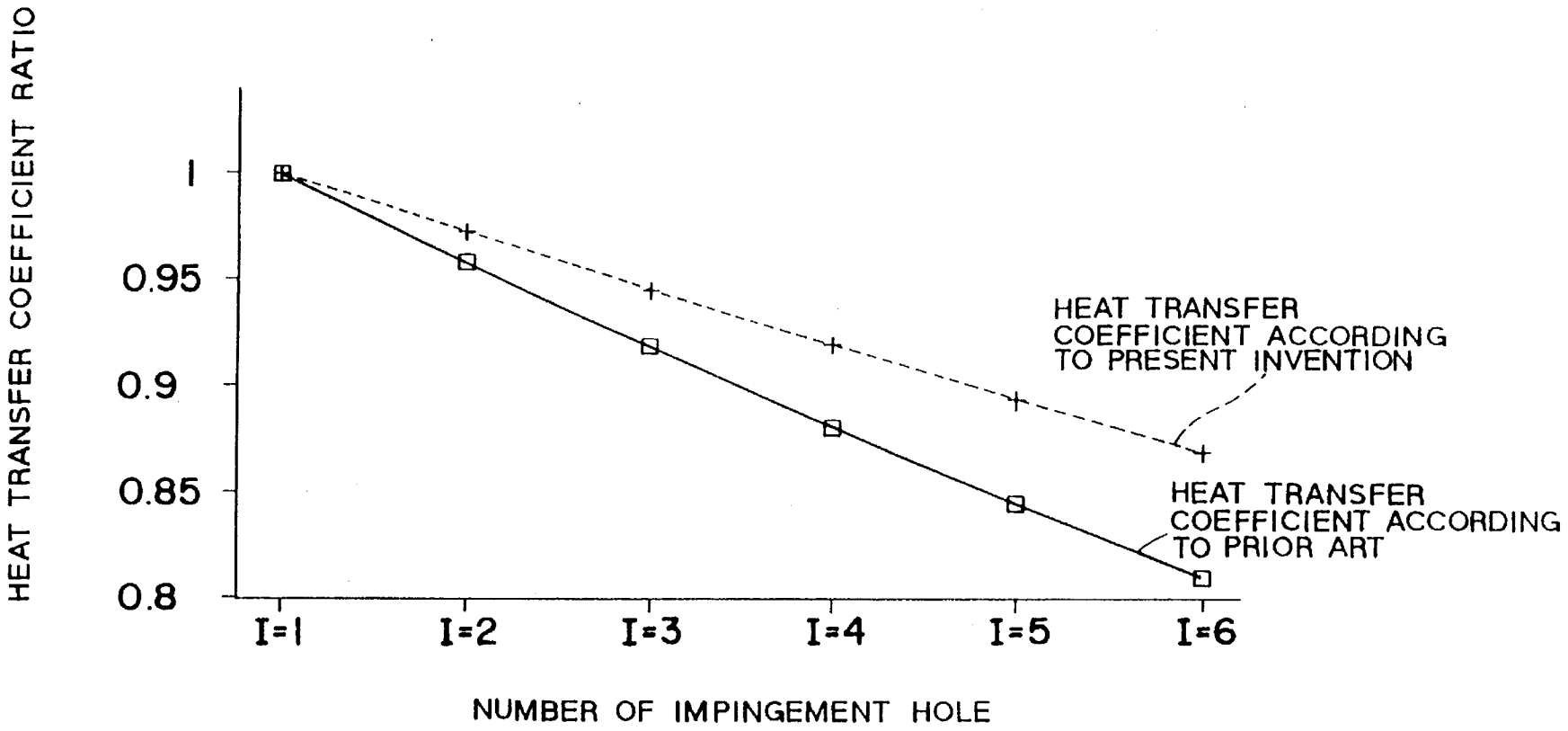
FIG. 4 is a graph comparing the reduction of the heat transfer coefficient of the first embodiment with that of the prior art.

FIG. 4 is a graph showing the case in which the area of the space 11 is increased to 1.5 time that of the prior art and the reductions of the heat transfer coefficient of the six impingement holes are calculated and compared with those of the prior art, wherein the abscissa shows the number of the impingement holes and the ordinate shows a heat transfer coefficient in the impingement hole of i=1 in the prior art and the heat transfer coefficient is shown by being subjected to a dimension-free processing.

In FIG. 4, although the heat transfer coefficient of the sixth (i=6) impingement hole of the prior art is reduced about 20% as compared with that of the first (i=1) impingement hole because the space cooling air 11*a* is gradually increased, the reduction of the heat transfer coefficient in this embodiment is about 12% and thus a large effect is obtained.

As described above, according to this embodiment, the area of the space 11 is increased while keeping the distance Yi between the impingement hole 9 and the cooling blade main body 5 as large as that of the prior art by the provision of the impingement holes 9 with the projections 20. As a result, the quantity of flow of mass per unit area Wx, i of the space cooling air 11*a* is reduced and the interference of the impingement cooling air 9*a* with the space cooling air 11*a* is prevented, so that the reduction of the heat transfer coefficient in impingement cooling can be reduced.

Note that when the projections 20 are formed in the diaphragm and the impingement holes 9 are defined in the projections in this embodiment, the same operation and advantage can be also obtained in the shroud segment.

Figure 5:
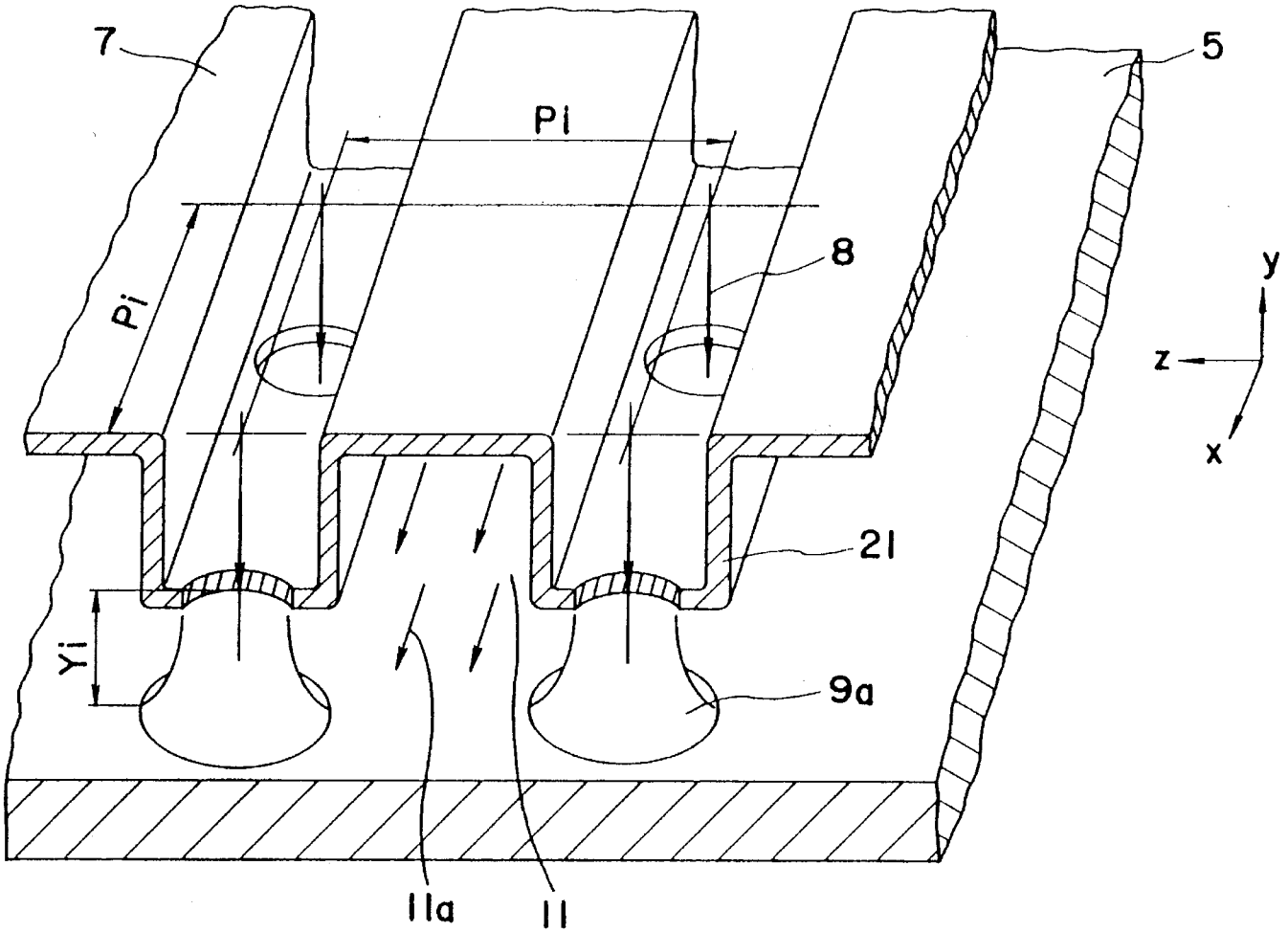
FIG. 5 is an enlarged perspective view showing the main portion of a first modification of the first embodiment.

FIG. 5 is an enlarged perspective view showing the main portion of a first modification of the first embodiment of the turbine cooling blade according to the present invention and, in FIG. 5, the same numerals as used in the first embodiment are used to denote the same portions for the convenience of description. In the first modification, a plurality of channel-shaped projections 21 projecting to a cooling blade main body 5 side are formed in an insert core 7 in a direction substantially parallel to the flow of the cooling air and a circular-shaped impingement hole 9 is defined in each of the projections 21.

The area of a space 11 can be increased while keeping a distance Yi between the impingement hole 9 and the cooling blade main body 5 as large as that of the prior art also in this first modification. Further, the first modification can be made more easily than the first embodiment by the provision of the row-shaped projections 21.

Figure 6:
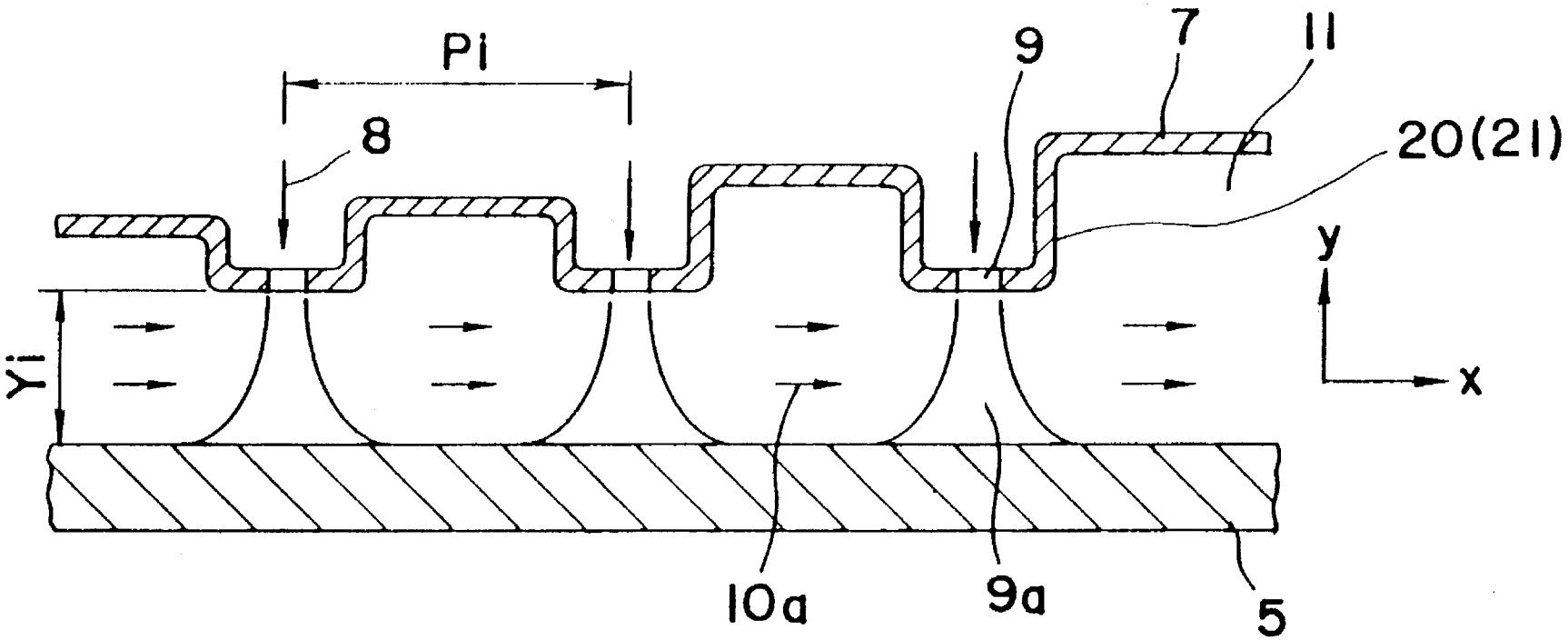
FIG. 6 is a longitudinal cross sectional view showing a second modification of the first embodiment.

FIG. 6 is a longitudinal cross sectional view showing a second modification of the first embodiment of the turbine cooling blade according to the present invention, and in FIG. 6, the same numerals as used in the first embodiment are used to denote the same portions for the convenience of description. Since the space cooling air 11*a* collected as impingement cooling air 9*a* flows downstream, the quantity of the space cooling air 11*a* is increased toward a rear edge 9, for example by utilizing a staged insert core as illustrated in FIG. 6.

Thus, in the second modification, a space 11 between an insert core 7 and a cooling blade main body 5 is increased toward the rear edge 9. According to the second modification, since space cooing air 11*a* has a uniform flow velocity, the heat transfer coefficient in impingement cooling can be more uniformly distributed.

Further, it is to be noted that the first and second modifications can be similarly applied to a shroud segment when the insert core 7 is a diaphragm and the cooling blade main body 5 is the shroud segment.

Figure 7:
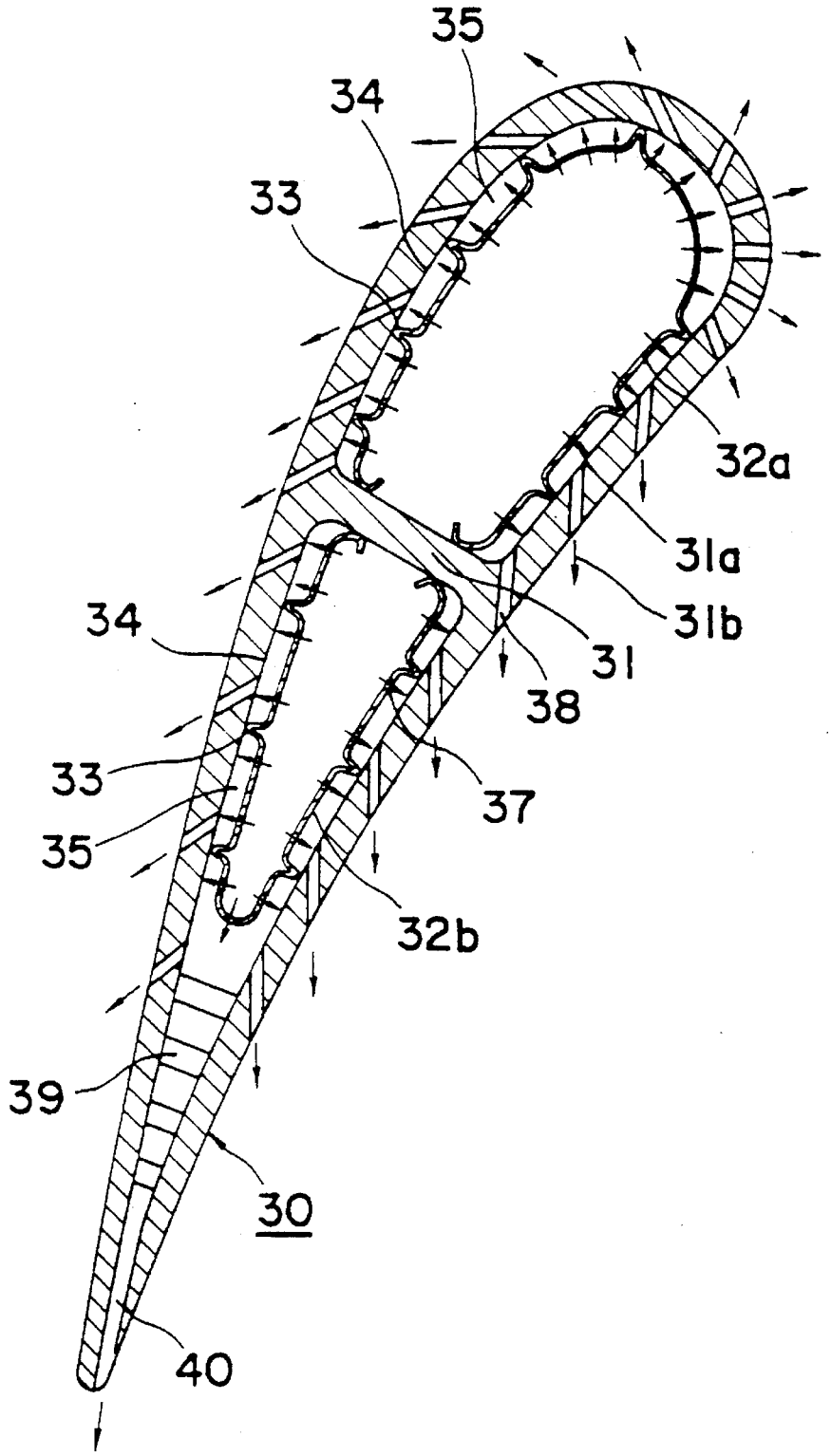
FIG. 7 is a lateral cross sectional view of a second embodiment of the turbine cooling blade according to the present invention.
Figure 8:
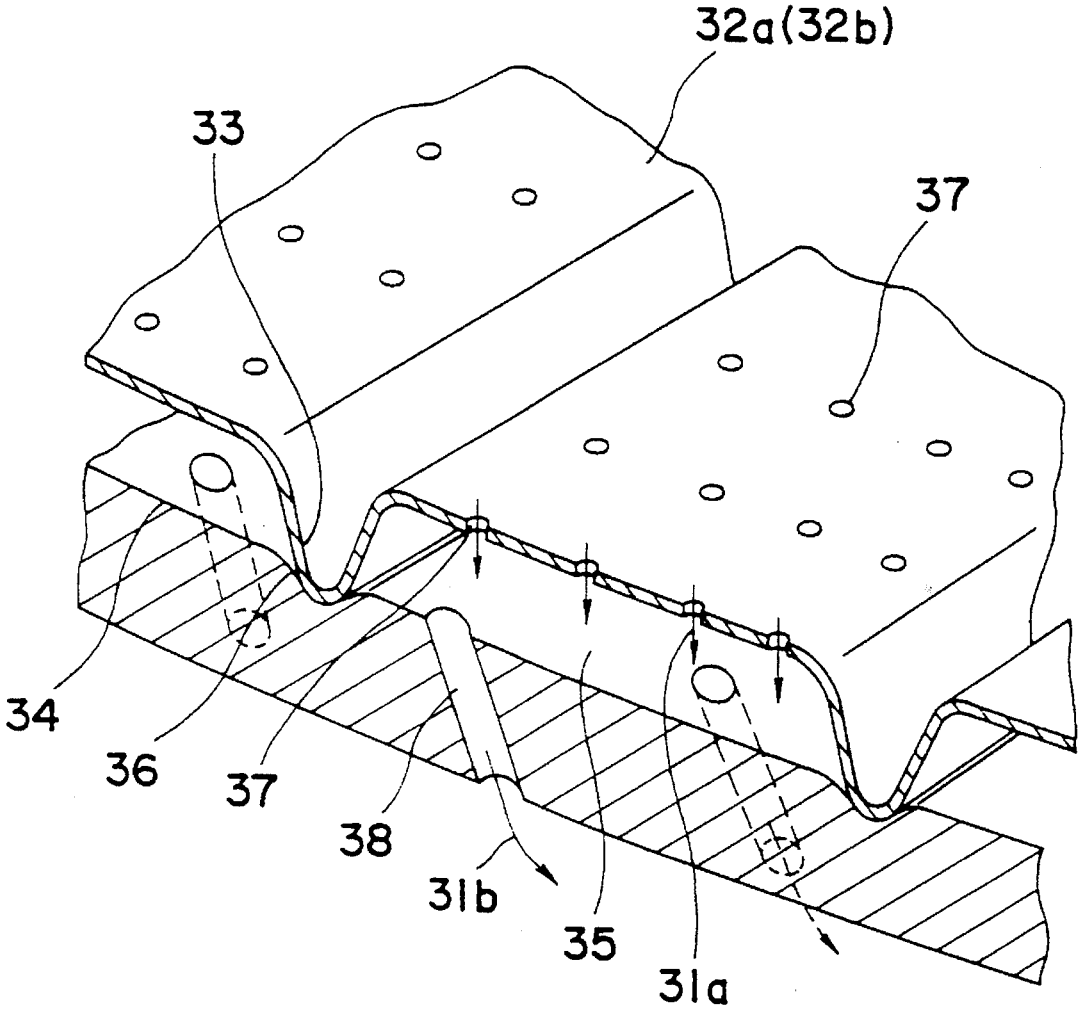
FIG. 8 is an enlarged perspective view showing the main portion of the second embodiment.

FIG. 7 is a longitudinal cross sectional view showing a second embodiment of the turbine cooling blade according to the present invention and FIG. 8 is an enlarged perspective view showing the main portion of the second embodiment.

As shown in FIG. 7, the inside of the effective blade portion of a cooling blade main body 30 is formed as a hollow structure which is divided into two chambers by a partition wall 31. Insert cores 32*a*, 32*b* are accommodated in each of the chambers. Projected portions 33 are formed in the circumference of each of the insert cores 32*a*, 32*b* at several positions and extended in the span direction of the blade, and sectioned chambers or cells 35 are formed by the abutment of the projected portions 33 against a blade hollow inner wall 34. The portions of the blade hollow inner wall 34 in contact with the projected portions 33 are formed in a recessed shape as shown in FIG. 8, so that the projected portions 33 are engaged with the recessed portions 36 of the hollow inner wall 34.

Each of the insert cores 32*a*, 32*b* is entirely provided with impingement holes 37 passing from the inside to the outside except at the projected portions 33. Film cooling holes 38 pass from the respective chambers 35 to the outside surface of the blade. Further, a pin fin 39 and a rear edge blow-off hole 40 are defined in the hollow portion on the rear edge side of the blade.

The operation of this embodiment will be described hereunder.

Cooling air 31*a* supplied into the insert cores 32*a*, 32*b* flows into the respective chambers 35 from the impingement holes 37 and at the same time is jetted to impinge on the blade hollow inner wall 34 to cool the same. Since the projected portions 33 of the insert cores 32*a*, 32*b* are pressed against the recessed portions 36 of the hollow inner wall by a pressure difference between the inside and the outside of the insert cores 32*a*, 32*b*, the flow of the cooling air between the respective chambers 35 is suppressed and isolated by pressure.

Then, the cooling air 31*a* which has flowed into the chambers 35 is converted to film cooling air 31*b* blown off to a blade surface from the film cooling holes 38 to film cool the same. On the other hand, a portion of the cooling air 31*a* used for impingement cooling from the insert core 32*b* convection cools the rear edge portion through the pin fin 39 and the rear edge blow-off hole 40 and then is discharged to the outside of the blade.

In the case of film cooling, optimum fluid conditions must be set on the cooling air side (cells 35) with respect to the fluid conditions on a main fluid side at blow-off positions. For this purpose, the pressure in the chambers 35 is determined depending upon the inner pressure of the insert cores 32*a*, 32*b*, the film cooling air 31*b* from the chambers 35, the blade surface pressures at the blow-off positions, the shape of the impingement holes 37 (number and diameter) and the shape of the film cooling holes 38 (number and diameter).

Therefore, the optimum blow-off conditions can be obtained by selecting the number and disposition of the cells 35 and the shapes of the impingement holes 37 and film cooling holes 38 corresponding to the respective chambers 35 depending upon the distribution of static pressure on the outside wall surface of the blade and the blow-off positions of the film cooling air 31*b*. With this arrangement, the effect of a cross flow against the impingement jet 31*a* can be suppressed, so that an impingement cooling effect is also improved.

Figure 9:
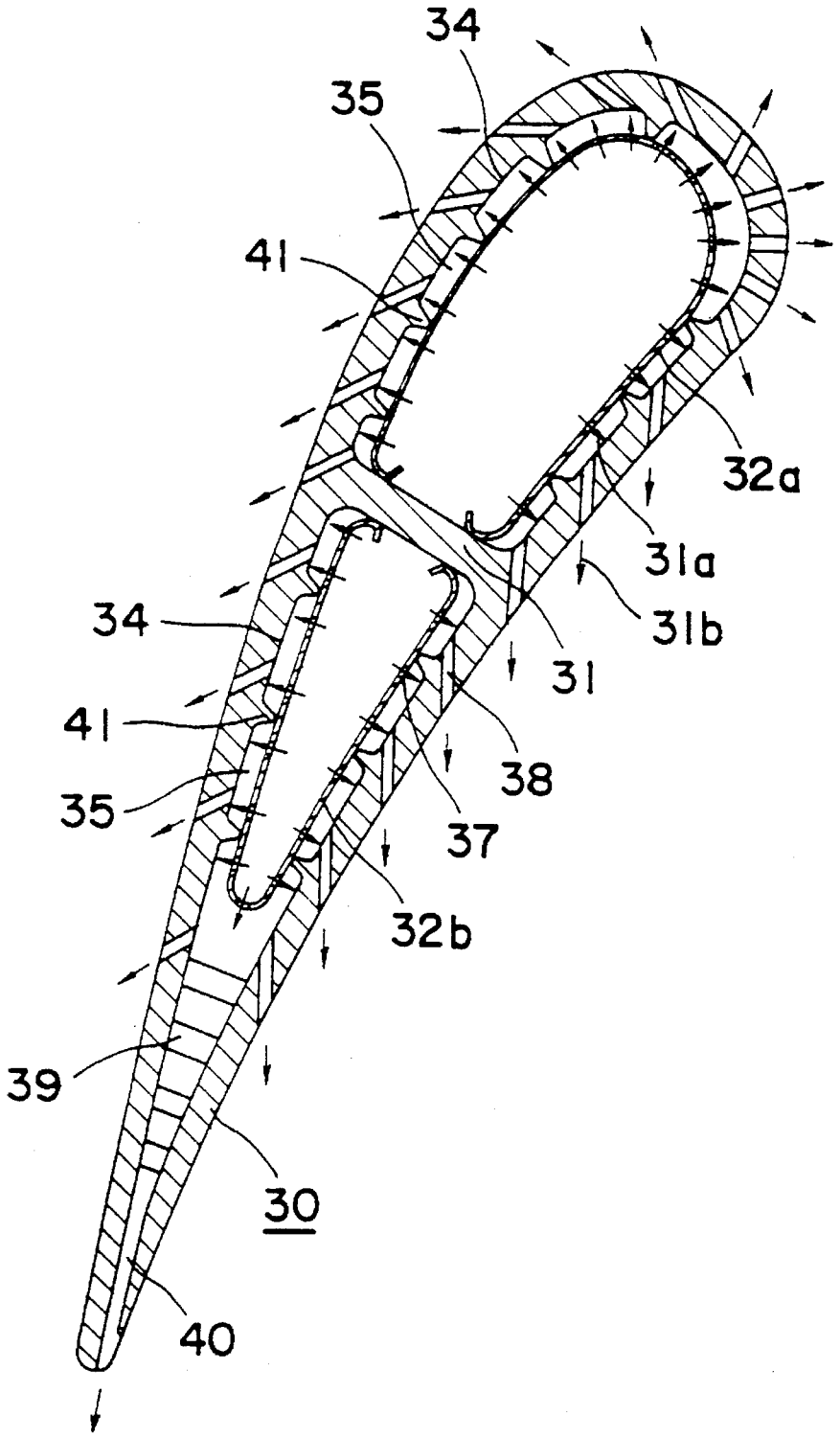
FIG. 9 is a lateral cross sectional view showing a modification of the second embodiment.
Figure 10:
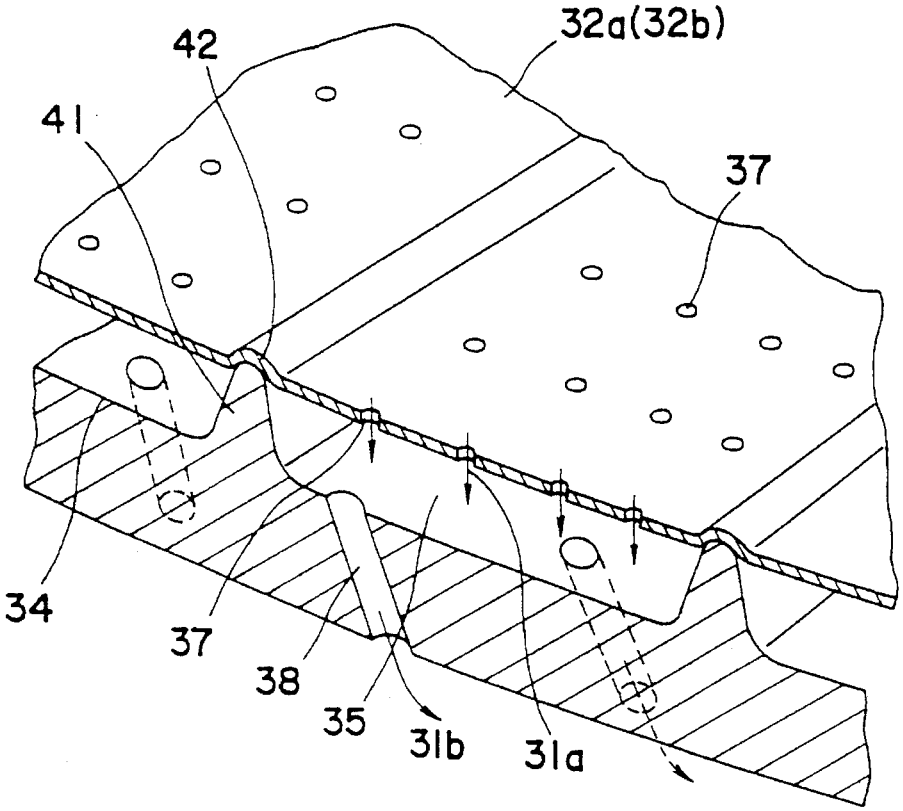
FIG. 10 is an enlarged perspective view showing the main portion of the modification of the second embodiment.
Figure 11:
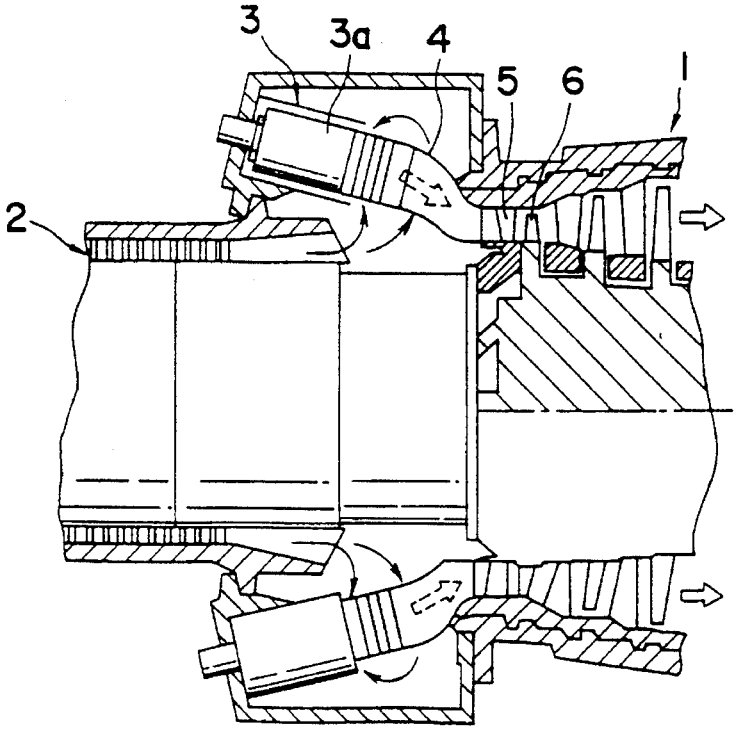
FIG. 11 is a cross sectional view showing the schematic arrangement of a usual gas turbine.
Figure 12:
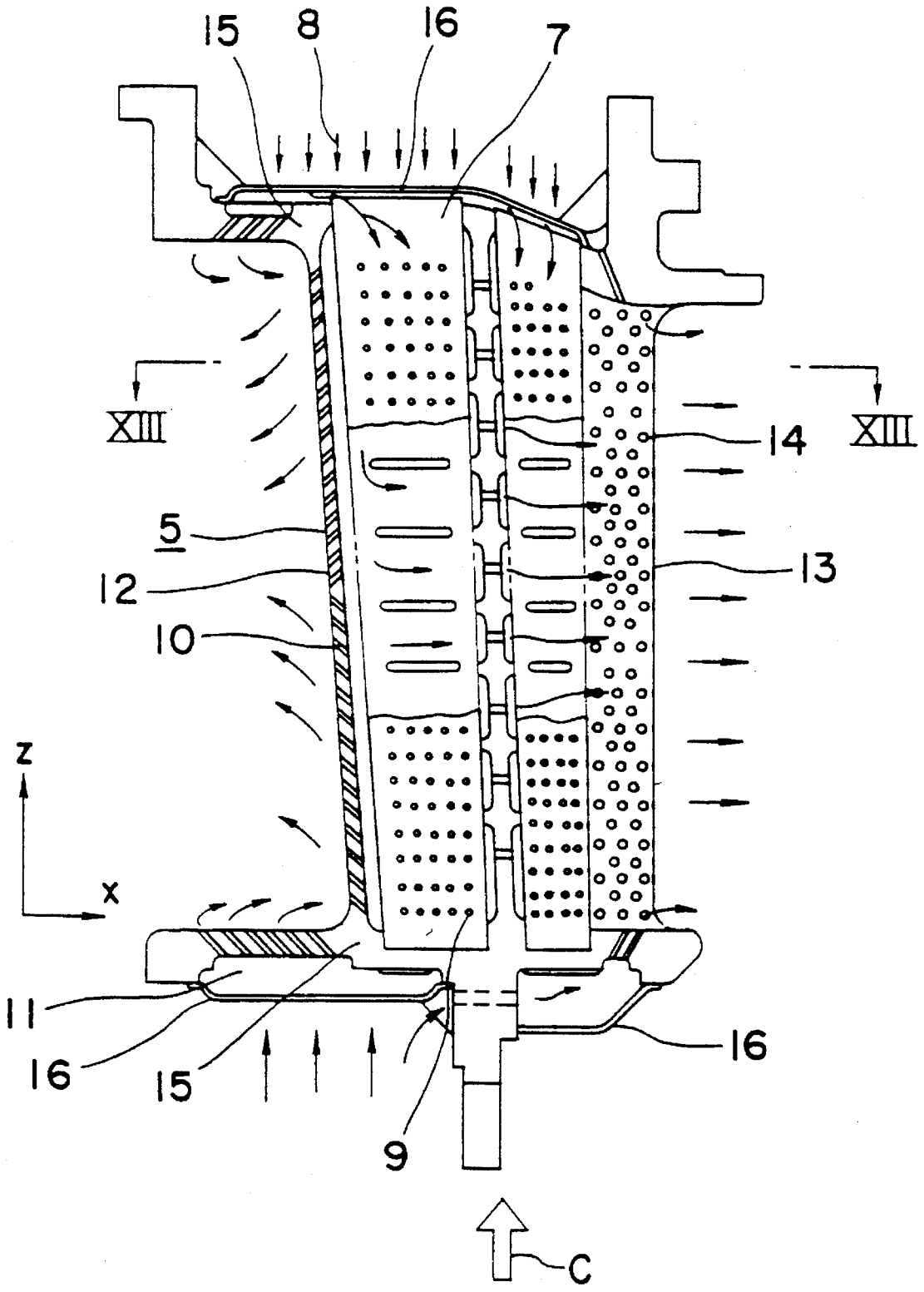
FIG. 12 is a longitudinal cross sectional view showing a conventional gas turbine cooling blade.
Figure 13:
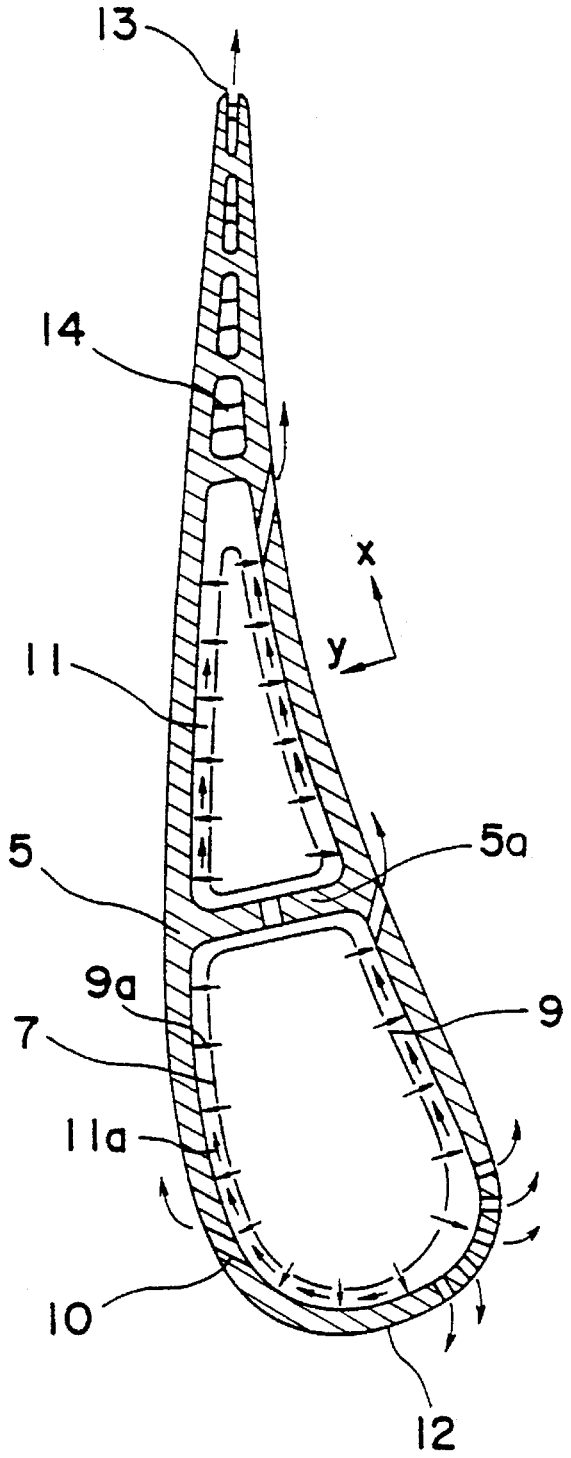
FIG. 13 PRIOR ART
FIG. 13 is a cross sectional view taken along the line XIII—XIII of FIG. 12.
Figure 14:
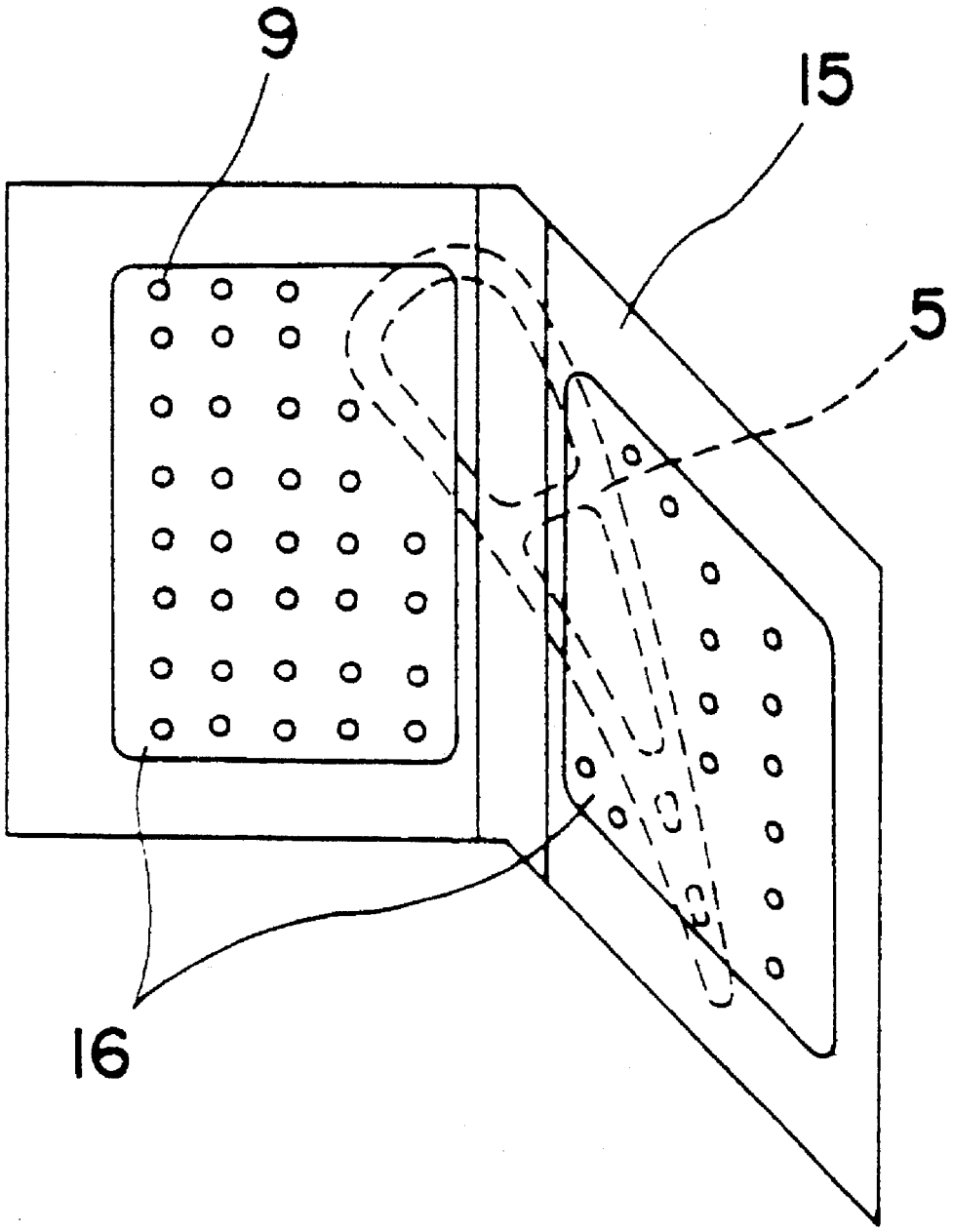
FIG. 14 PRIOR ART
FIG. 14 is a view observed from the C direction of FIG. 12.
Figure 15:
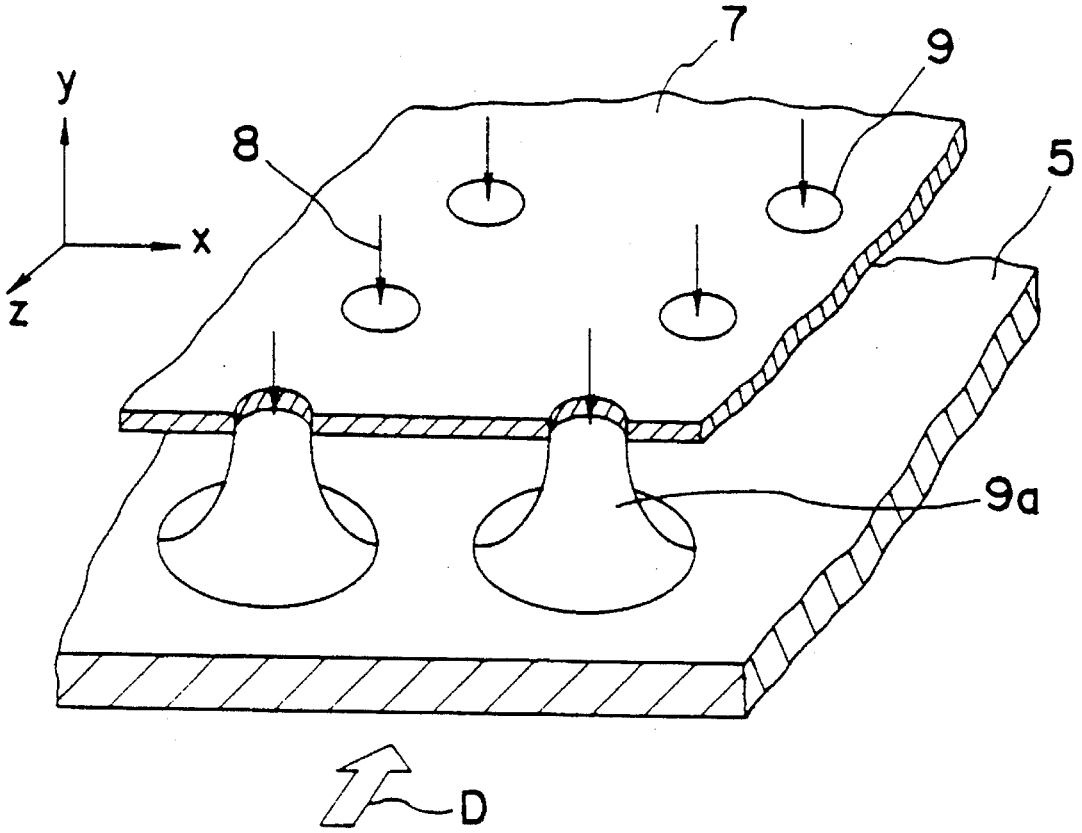
FIG. 15 PRIOR ART
FIG. 15 is an enlarged perspective view showing ideal impingement cooling.
Figure 16:
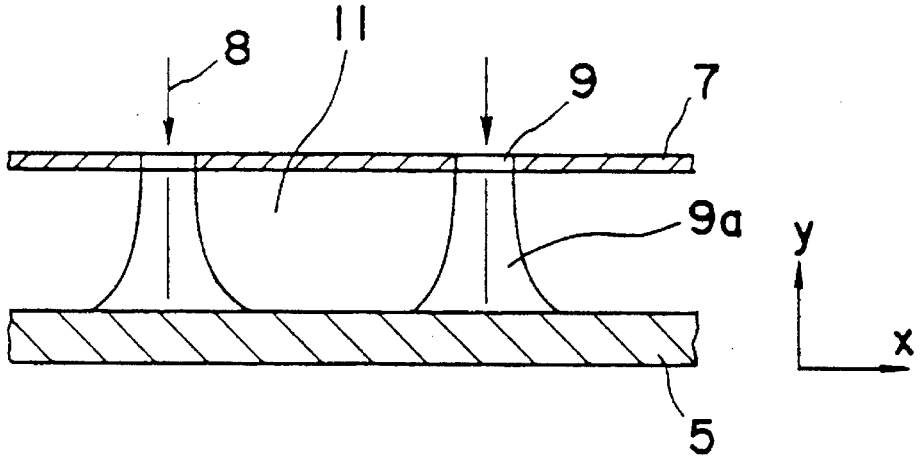
FIG. 16 PRIOR ART
FIG. 16 is a view observed from the D direction of FIG. 15.
Figure 17:
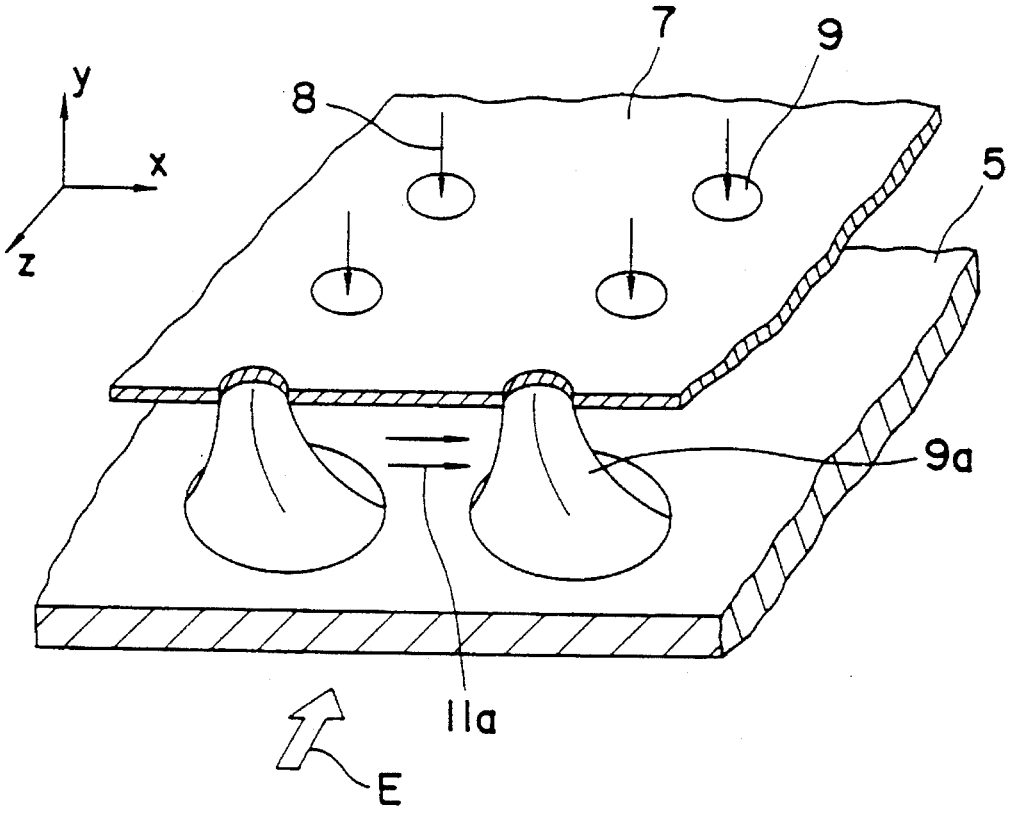
FIG. 17 PRIOR ART
FIG. 17 is an enlarged cross sectional view showing actual impingement cooling.
Figure 18:
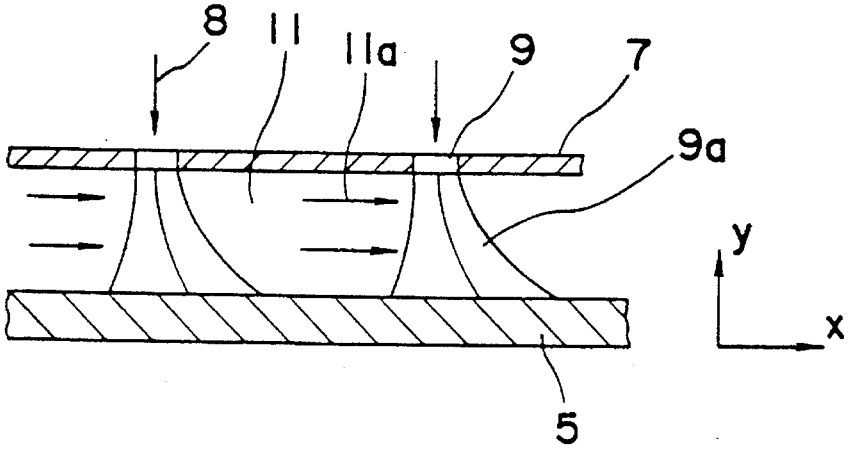
FIG. 18 PRIOR ART
FIG. 18 is a view observed from the E direction of FIG. 17.

FIG. 9 is a longitudinal cross sectional view showing a modification of the second embodiment of the turbine cooling blade according to the present invention and FIG. 10 is an enlarged perspective view showing the main portion of the modification and, in FIG. 10, the same numerals as used in the second embodiment are used to denote the same portions for the convenience of description.

In this modification, the projected portions 41 of a hollow inner wall 34 extending in the span direction of a blade are formed on the inner circumference of the hollow inner wall 34 at several positions at predetermined intervals. The projected portions 41 serve as means for forming air chambers as cells between insert cores 32*a*, 32*b* and the hollow inner wall 34. The projected portions 41 of the hollow inner wall 34 are caused to abut against the surfaces of insert cores 32*a*, 32*b* to form the chambers 35.

The portions of the insert cores 32*a*, 32*b* in contact with the projected portions 41 of the hollow inner wall are formed in a recessed shape and the projected portions 41 of the hollow inner wall 34 are engaged with the thus formed recessed portions 42. With this arrangement, the same advantage as that of the second embodiment can be obtained. It is of course noted that the other arrangements and operations of the modification are the same as those of the second embodiment though they are not described herein.

The hollow inner wall recessed portions 36 and the hollow inner wall projected portions 41 can be integrally formed with the cooling blade main body 30 by precision casting and the projected portions 33 and the recessed potions 42 corresponding to them can be integrally stamped with the insert cores 32*a*, 32*b*.

According to the preferred embodiments of the present invention, since projections are formed on the insert core so as to project to the cooling blade body, with the impingement holes defined in the projections, the space between the insert core and the cooling blade body can be increased. As a result, the flow velocity of cooling air having performed impingement cooling is reduced so that the interference of the cooling air with cooling air after impingement, by which the cooling effect of the impingement cooling is lowered, can be attenuated. Thus, since an amount of the heat transfer coefficient of impingement cooling reduced by the interference can be reduced, the cooling effect can be increased.

Furthermore, since the space formed between the cooling blade body and the insert core is divided into a plurality of the sectioned chambers or cells and a plurality of the film cooling holes are defined in each of the chambers in the radial direction of the cooling blade body for blowing off cooling air from each chamber, the pressure of the cooling air in each chamber can be kept to an optimum pressure in accordance with the static pressure of the blade surface so that a maximum film effect can be obtained.

As a result, the blade body can be sufficiently cooled, a gas turbine of high efficiency can be realized, and when the gas turbine is applied to a power generation plant, heat efficiency can be improved.

The projected portions of the insert core are engaged with the recessed portions of the cooling blade body, or the projected portions of the blade body may be engaged with the recessed portions of the insert core, so that cooling air can be sealed effectively in the chambers and the operational reliability can be improved.

What is claimed is:

1. A turbine cooling blade comprising:

a blade body having a structure defining an inner hollow portion;

an insert core member fitted into the inner hollow portion of the blade body with a space therebetween; and a plurality of projections formed to said insert core member so as to project towards an inner surface of the blade body, said projections being formed with impingement holes through which cooling air flows from an inside of the insert core member towards the space between the insert core member and the blade body, each of said projections having a cylindrical outer appearance provided with an impingement hole.

2. A turbine cooling blade according to claim 1, wherein said space between the insert core member and the inner surface of the blade body is formed so as to be widened towards a downstream side of the flow of the cooling air.

3. A turbine cooling blade comprising:

a blade body having a structure defining an inner hollow portion;

an insert core member fitted into the inner hollow portion of the blade body with a space therebetween; and a plurality of projections formed to said insert core member so as to project towards an inner surface of the blade body, said projections being formed with impingement holes through which cooling air flows from an inside of the insert core member towards the space between the insert core member and the blade body, wherein said space between the insert core member and the inner surface of the blade body is formed so as to be widened towards a downstream side of the flow of the cooling air.

4. The turbine cooling blade of claim 3 wherein said projections are arranged in a row in a direction substantially parallel to a flow direction of the cooling air.

5. A turbine cooling blade comprising:

a blade body having a structure defining an inner hollow portion;

an insert core member adapted to be fitted into the inner hollow portion of the blade body with a space therebetween and formed with a number of impingement holes;

a plurality of partitioning members partitioning the space into a plurality of sectioned chambers between the insert core member and an inner surface of the blade body, said partitioning members extending in a span direction of the blade body;

a film cooling means formed of a number of film cooling holes formed so as to penetrate the blade body from the sectioned chambers to an outer atmosphere side of the blade body to cover with cooling air substantially an entire outer surface portion of the blade body, wherein at least one impingement hole is formed to each one of the sectioned chambers and at least one film cooling hole is formed to each one of the sectioned chambers, and wherein cooling air flows from an inside of the insert core towards the sectioned chambers through the impingement holes to thereby perform film cooling of the entire outer surface of the blade body and regulate inner pressures of the respective sectioned chambers, wherein said partitioning members are formed on one of said insert core member and said blade body as projections so as to project from the one of said insert core member and said blade body toward an inner surface of an other of said insert core member and said blade body and abut at projected end portions thereof against the inner surface of the other of said insert core member and said blade body blade body; and a plurality of recessed portions formed on said other of said insert core member and said blade body and to which projected end portions of said projections are respectively fitted.

6. A turbine cooling blade according to claim 5, wherein said partitioning members are formed integrally with said insert core member.

7. A turbine cooling blade according to claim 5, wherein said partitioning members are formed integrally with said blade body.

8. The turbine cooling blade of claim 5 wherein said one of said insert core member and said blade body is said insert core member.

9. The turbine cooling blade of claim 5 wherein said one of said insert core member and said blade body is said blade body.

* * * * *